US009188031B2

(12) United States Patent
Hoji et al.

(10) Patent No.: US 9,188,031 B2
(45) Date of Patent: Nov. 17, 2015

(54) ENGINE LUBRICATING OIL SUPPLY DEVICE

(75) Inventors: Takeshi Hoji, Tokyo (JP); Mitsuo Nakajima, Tokyo (JP)

(73) Assignee: TBK Co., Ltd., Tokyo (JP)

( * ) Notice: Subject to any disclaimer, the term of this patent is extended or adjusted under 35 U.S.C. 154(b) by 0 days.

(21) Appl. No.: 13/514,466

(22) PCT Filed: Dec. 7, 2009

(86) PCT No.: PCT/JP2009/006654
§ 371 (c)(1),
(2), (4) Date: Jun. 7, 2012

(87) PCT Pub. No.: WO2011/070604
PCT Pub. Date: Jun. 16, 2011

(65) Prior Publication Data

US 2012/0240893 A1 Sep. 27, 2012

(51) Int. Cl.
*F01M 1/02* (2006.01)
*F01M 1/16* (2006.01)

(52) U.S. Cl.
CPC ..... *F01M 1/16* (2013.01)

(58) Field of Classification Search
CPC ..... F01M 1/16; F01M 1/02; F01M 1/08; F01M 9/06; F01M 9/10; F01M 2001/023; F01M 1/06; F01L 9/025; F01L 2001/3443; F01L 2001/34426; F01L 2001/34433; F01L 2001/34446; F01L 2810/02; F01L 9/02; F01L 9/023; F01L 2001/34483
USPC ..... 123/196 R, 196 V, 188.1, 190.13, 123/190.16, 188.9, 188.12, 188.17
See application file for complete search history.

(56) References Cited

U.S. PATENT DOCUMENTS 2,370,506 A * 2/1945 Tabb ..... 417/228
3,399,659 A * 9/1968 Isoda ..... 123/182.1

(Continued)

FOREIGN PATENT DOCUMENTS

JP 60-099370 U 7/1985
JP S60-99370 U 7/1985

(Continued)

OTHER PUBLICATIONS

International Search Report; PCT/JP2009/006654; Mar. 16, 2010.
An Office Action; "Decision of Refusal," issued by the Japanese Patent Office on Apr. 4, 2014, which corresponds to Japanese Patent Application No. 2011-544973 and is related to U.S. Appl. No. 13/514,466.

(Continued)

*Primary Examiner* — Lindsay Low
*Assistant Examiner* — Long T Tran
(74) *Attorney, Agent, or Firm* — Studebaker & Brackett PC

(57) ABSTRACT

An engine lubricating oil supply device (1) according to the present invention is configured such that a connection hole (45) is opened and closed by a ball valve element (53) based on a balance between a biasing force of a shape memory spring (51) which changes in accordance with the temperature of the lubricating oil and a hydraulic pressure of the lubricating oil flowing into a piston chamber (31) such that the lubricating oil flowing into an accommodating space (44) from the connection hole (45) is drained via a second drain oil passage (46), thereby adjusting the degree of opening of a first drain oil passage (34) by causing a piston (35) to slide on the basis of a balance between a biasing force of a valve spring (39) and a pressure differential between an upstream chamber (32) and a downstream chamber (33) which is generated in accordance with a flow of the lubricating oil passing through an orifice (38).

4 Claims, 5 Drawing Sheets

(56) References Cited

U.S. PATENT DOCUMENTS

| | | | | |
|---|---|---|---|---|
| 4,016,897 | A * | 4/1977 | Asioli | 137/107 |
| 4,324,210 | A * | 4/1982 | Aoyama | 123/90.55 |
| 4,644,913 | A * | 2/1987 | Stoody, Jr. | 123/90.46 |
| 4,729,349 | A * | 3/1988 | Sonoda et al. | 123/90.34 |
| 4,813,408 | A * | 3/1989 | Katsumoto et al. | 123/196 AB |
| 6,905,317 | B2 * | 6/2005 | Hirabayashi et al. | 417/440 |
| 7,921,703 | B2 * | 4/2011 | Keller et al. | 73/114.55 |
| 8,186,327 | B2 * | 5/2012 | Ni | 123/196 CP |
| 2007/0034262 | A1 * | 2/2007 | Cozens et al. | 137/513 |
| 2007/0287562 | A1 * | 12/2007 | Assel | 474/110 |
| 2010/0192898 | A1 * | 8/2010 | Ni | 123/196 R |
| 2011/0146602 | A1 * | 6/2011 | Kato | 123/90.12 |
| 2011/0197846 | A1 * | 8/2011 | Shinomiya et al. | 123/196 R |
| 2011/0283968 | A1 * | 11/2011 | Anderson et al. | 123/196 R |

FOREIGN PATENT DOCUMENTS

| | | | |
|---|---|---|---|
| JP | S62-138975 | U | 9/1987 |
| JP | 62-248812 | | 10/1987 |
| JP | 01-166876 | U | 11/1989 |
| JP | H01-166876 | U | 11/1989 |
| JP | 03-029784 | U | 3/1991 |
| JP | 09-088533 | | 3/1997 |
| JP | 3122348 | | 10/2000 |

OTHER PUBLICATIONS

An Office Action; "Decision of Rejection," issued by the Japanese Patent Office on Apr. 4, 2014, which corresponds to Japanese Patent Application No. 2011-544973 and is related to U.S. Appl. No. 13/514,466; with English language translation.

An Office Action; "Notification of Reasons of Rejection," issued by the Japanese Patent Office on Sep. 6, 2013, which corresponds to Japanese Patent Application No. 2011-544973 and is related to U.S. Appl. No. 13/514,466; with English language translation.

The first Office Action issued by the State Intellectual Property Office of the People's Republic of China on Jan. 6, 2014, which corresponds to Chinese Patent Application No. 200980162347.3 and is related to U.S. Appl. No. 13/514,466; with English language translation.

The second Office Action issued by the State Intellectual Property Office of the People's Republic of China on Jul. 1, 2014, which corresponds to Chinese Patent Application No. 200980162347.3 and is related to U.S. Appl. No. 13/514,466; with English language translation.

Notification of the Third Office Action issued by the State Intellectual Property Office of the People's Republic of China on Jan. 4, 2015, which corresponds to Chinese Patent Application No. 200980162347.3 and is related to U.S. Appl. No. 13/514,466; with English language translation.

* cited by examiner

ENGINE LUBRICATING OIL SUPPLY DEVICE

TECHNICAL FIELD

The present invention relates to an engine lubricating oil supply device which supplies lubricating oil to an engine.

TECHNICAL BACKGROUND

In a diesel engine, lubricating oil (engine oil) stored in an oil pan is supplied (fed under pressure) by a lubricating oil supply device, such as an oil pump, for the purpose of lubricating and cooling various parts of the engine. However, in recent diesel engines, advances have been made in lowering the rated engine speed (number of revolutions), due to demands for reduced friction and reduced noise, and the like. In order to achieve high torque from a low engine speed range, turbo supercharging is carried out from low engine speeds, and engine oil is essential not only for lubrication and cooling of the turbo which is activated from a low engine speed range, but also as a special cooling jet for the pistons which are subjected to high torque and which generate heat. For this reason, it has become necessary to supply, from a low engine speed, an amount of lubricating oil which conventionally it has been necessary to supply to the various parts of the engine from the lubricating oil supply device principally in a high engine speed region. In order to respond to this, the ejection flow volume of lubricating oil is raised by increasing the size and supply rate of the oil pump.

On the other hand, with regard to the specifications of the oil pump (gear pump), the ejection pressure and the ejected oil volume are specified with reference to the lowest speed (number of revolutions) of the engine, the oil pump is driven in proportion with the engine speed and the ejection volume of the lubricating oil from the oil pump increases in proportion with the engine speed. However, the flow rate of lubricating oil required for lubrication of the engine is inevitably proportional to the speed of the engine, and in a high speed region of the engine, excess work is generated in the oil pump and the load on the engine is increased. Therefore, a lubricating oil supply device is known, in which the engine speed and the ejection pressure from the oil pump are detected by detection means, whereupon an oil regulating valve is driven on the basis of electric control by a controller (ECU) and a portion of the lubricating oil ejected from the oil pump is relieved, in such a manner that lubricating oil approaching the required volume corresponding to the engine speed is supplied to the respective parts of the engine (see, for example, Patent Document 1).

PRIOR ARTS LIST

Patent Document

Patent Document 1: Japanese Patent No. 3122348(B2)

SUMMARY OF THE INVENTION

Problems to be Solved by the Invention

However, in an oil pump which is matched to achieve an optimal state corresponding to the engine requirements at a high oil temperature, in order to prevent seizing of the engine at high revolutions and high output, there is a problem in that the viscosity of the lubricating oil is high at low temperatures, for instance, when the engine is started from a cold state, and this gives rise to friction (torque) and poorer fuel consumption by the engine. In the lubricating oil supply device described in Patent Document 1, a composition is disclosed in which the amount of oil supplied to the engine is adjusted in accordance with the temperature of the lubricating oil as detected by an oil temperature detector, but this is based on electrical control by the controller described above, and therefore the composition thereof is complicated and it becomes more difficult to ensure space to include the control system and the manufacturing costs increase.

The present invention was devised in view of these problems, an object thereof being to provide an engine lubricating oil supply device which does not produce unnecessary increase in the drive loss in an oil pump, even when the engine is started at low temperature, by means of a simple composition.

Means to Solve the Problems

In order to resolve the problems described above, the engine lubricating oil supply device relating to the present invention is an engine lubricating oil supply device constituted by an oil pump which is driven by an engine, sucks in lubricating oil stored in an oil pan, and supplies the lubricating oil to lubricated parts of the engine, and an oil regulating valve which conveys a portion of the lubricating oil supplied to the lubricated parts of the engine from the oil pump, to a first drain oil passage via a relief hole connecting to an ejection port of the oil pump, and drains the portion of the lubricating oil to the oil pan, wherein the oil regulating valve includes: a casing having a piston chamber connected to the relief hole; a piston member which is arranged slidably inside the piston chamber and which opens and closes the first drain oil passage (for example, the piston 35 in the embodiment); first biasing means for biasing the piston member to a closed position side of the first drain oil passage (for example, the valve spring 39 in the embodiment); an orifice which is formed in the piston member and connects a front surface side space and a rear surface side of the piston member in the piston chamber; a housing having a valve hole (for example, the connection hole 45 according to the present embodiment) connecting an accommodating space formed therein and the rear surface side space, and also having a second drain oil passage which connects the accommodating space and the oil pan; a valve element which is provided inside the accommodating space and opens and closes the valve hole (for example, the ball valve element 53 in the embodiment); and second biasing means for biasing the valve element in a valve closing direction toward the valve hole side by a biasing force corresponding to a temperature of the lubricating oil (for example, the spring unit 50 in the embodiment). The engine lubricating oil supply device opens and closes the valve hole by the valve element on the basis of a balance between a biasing force of the second biasing means which changes in accordance with the temperature of the lubricating oil and a hydraulic pressure of the lubricating oil flowing into the rear surface side space, such that the lubricating oil flowing into the accommodating space from the valve hole is drained via the second drain oil passage, thereby adjusting a degree of opening of the first drain oil passage by causing the piston member to slide on the basis of a balance between a biasing force of the first biasing means and a pressure differential between the front surface side space and the rear surface side space which is generated in accordance with a flow of lubricating oil passing through the orifice.

In the engine lubricating oil supply device which is composed in this way, desirably, the second biasing means comprises a shape memory spring which directly or indirectly senses the temperature of the lubricating oil and applies a biasing force corresponding to the sensed temperature to the valve element, and a bias spring which applies a biasing force to the valve element in the valve closing direction, and a combined force of the biasing forces of the shape memory spring and the bias spring corresponding to the sensed temperature is applied to the valve element.

Effects of the Invention

According to the engine lubricating oil supply device relating to the present invention, it is possible to adjust the operating pressure of the oil regulating valve for opening the drain oil passage of the lubricating oil, on the basis of a balance between the pressure of the lubricating oil supplied to the lubricated parts of the engine from the oil pump which is driven in coordination with the engine, and the biasing force of the second biasing means which changes in accordance with the temperature of the lubricating oil. For this reason, it is possible appropriately to adjust the volume of lubricating oil which is relieved, of the lubricating oil supplied from the oil pump to the engine, in accordance with the speed of revolution of the oil pump and the temperature of the lubricating oil. Therefore, it is also possible to supply lubricating oil of a required volume corresponding to the speed of the engine, appropriately, as well as being able to make efficient use of the output of the engine and hence to improve the fuel consumption of the engine, by lowering the pump ejection pressure in low temperature conditions when the viscosity of the lubricating oil is high, for instance, during cold start-up of the engine, and thus preventing the oil pump from performing an excess amount of work (preventing increase in friction). Furthermore, since the flow volume of the lubricating oil can be controlled by means of a simple composition which does not use any electrical control by a controller (ECU), then it is possible to achieve cost reduction, space reduction and energy savings, and the like.

Furthermore, in the invention described above, a composition is adopted in which combined biasing forces of a bias spring and a shape memory spring corresponding to a sensed temperature are applied to a valve element, thereby making it possible to apply a biasing force to the valve element in the valve closing direction, reliably, regardless of the temperature of the lubricating oil. For example, even in a case where the biasing force of the shape memory spring for closing the valve hole is very small when the sensed temperature is low, the opening and closing of the valve hole is mainly adjusted by the biasing force of the bias spring when the oil temperature is low, whereas the opening and closing of the valve hole can be adjusted by the combined biasing forces of the shape memory spring and the bias spring when the oil temperature is high. Therefore, it is possible to adjust the drain volume of the lubricating oil to an appropriate volume.

DESCRIPTION OF THE EMBODIMENTS

Figure 1:
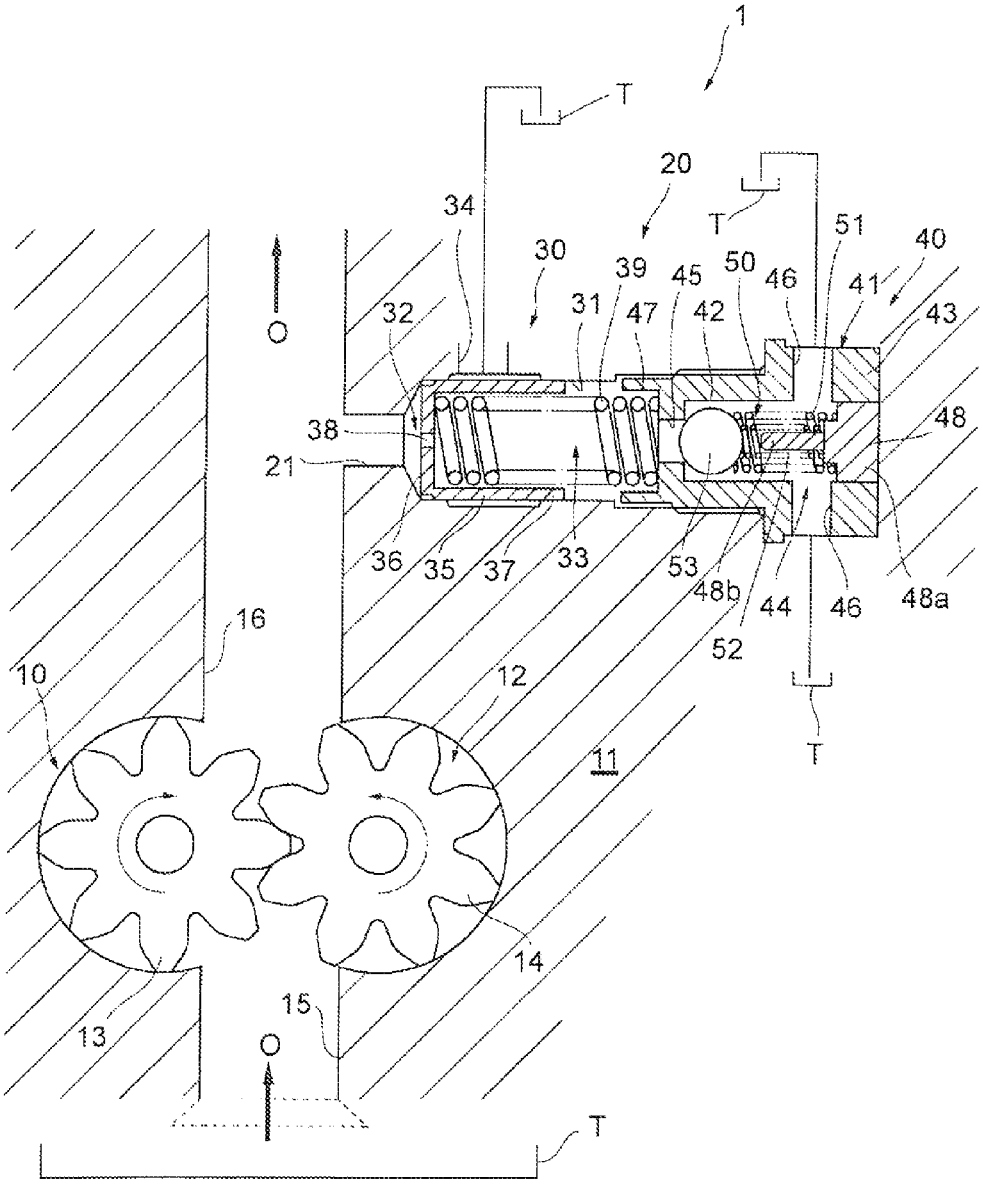
FIG. 1 is a schematic drawing showing an engine lubricating oil supply device relating to one embodiment of the present invention.
Figure 2:
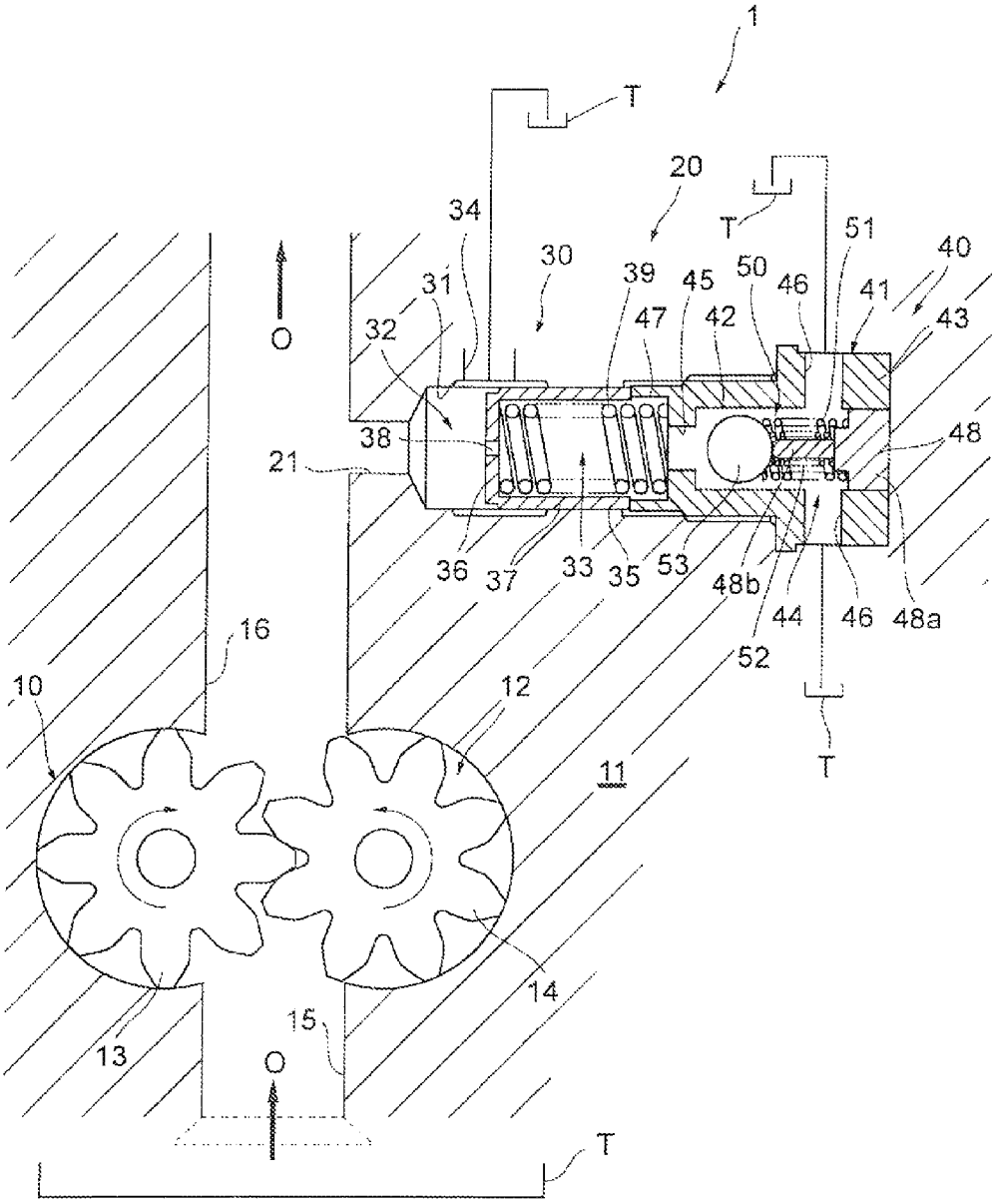
FIG. 2 is a schematic drawing showing an operating state of the engine lubricating oil supply device described above.

Below, a desirable embodiment of the invention is described with reference to the drawings. FIG. 1 and FIG. 2 show an engine lubricating oil supply device relating to one embodiment of the invention. The engine lubricating oil supply device 1 sucks in lubricating oil stored in an oil pan (lubricating oil tank) provided in a vehicle (not illustrated) and ejects lubricating oil into a lubricating oil passage which is connected to respective parts of an engine (engine lubricating parts). The engine lubricating oil supply device 1 is composed by an oil pump 10 and an oil regulating valve 20.

The oil pump 10 is an external meshing type of gear pump comprising a drive gear 13 and an idle gear 14 which mesh with each other on their outer surfaces and are provided rotatably about mutually parallel rotational axles, and a casing 11 which includes a pump chamber 12 in which the drive gear 13 and the idle gear 14 are accommodated and held with their tooth tips and side faces in mutual contact.

The rotational axle of the drive gear 13 is connected to an engine output shaft via a transmission gear (not illustrated), and by transmitting the rotational drive force of the engine output shaft to this rotational axle, the drive gear 13 and the idle gear 14 are caused to rotate in unison in the direction of the arrow in the diagram, in a meshed state. The rotational axles of the drive gear 13 and the idle gear 14 are supported rotatably in the casing 11 via bearings (not shown) which are arranged inside the casing 11. The gears 13 and 14 are involute tooth flat gears, and are formed to have the same cross-sectional shape.

An intake hole 15 and an ejection hole 16 are formed in the casing 11 so as to connect with the pump chamber 12, the intake hole 15 being connected to the oil pan T and the ejection hole 16 being connected to a lubricating oil passage of the engine.

In the oil pump 10 composed in this fashion, when the gears 13, 14 are rotated by driving the engine, the lubricating oil which has been sucked in from the oil pan T via the suction hole 15 as indicated by arrow O enters into the tooth grooves of the gears 13, 14 (the gaps between the tooth tips), and is conveyed to the ejection hole 16 due to the rotational movement and supplied under pressure to the various parts of the engine via the lubricating oil passage.

Here, a relief hole 21 extending in a direction perpendicular to the ejection hole 16 is formed in a side face of the ejection hole 16, in the casing 11, and this relief hole 21 connects the ejection hole 16 with a piston chamber 31 of the oil regulating valve 20.

The oil regulating valve 20 is principally constituted by an opening and closing valve 30 connected to the relief hole 21, and a switching valve 40 connected to the opening and closing valve 30. Firstly, the composition of the switching valve 40 is described.

The switching valve 40 is constituted by a housing 41 provided in the casing 11, a cap member 48 which closes off the open end of the housing 41, a spring unit 50 comprising a shape memory spring 51 and a bias spring 52 which are supported coaxially on the cap member 48 inside the casing 11, and a ball valve element 53 which is supported by the springs 51 and 52.

The housing 41 is formed in a stepped round tubular shape constituted by a mutually integrated small diameter section 42 and large diameter section 43 extending in the axis direction of the round tube, and is fixed to the casing 11 by screwing a multi-ridge male thread formed on the outer circumference of the small diameter section 42 into a female thread in the casing 11. A substantially round cylindrical accommodating space 44 for disposing the ball valve element 53, and the like, is formed inside the housing 41, and a connection hole 45 which connects this accommodating space 44 with the piston chamber 31 of the opening and closing valve 30, and second drain oil passages 46 which connect the accommodating space 44 with the oil pan T are also formed in the housing 41. Furthermore, a piston receiving section 47 which is capable of abutting against and supporting the piston 35 of the opening and closing valve 30 is formed on the front end side of the small diameter section 42 so as to project in the axial direction.

The cap member 48 is constituted by a base section 48*a* which fits together with an end section of the housing 41, and a rod-shaped stopper section 48*b* which extends in an axial direction from this base section 48*a*. The springs 51, 52 are supported coaxially on the front surface side of the base section 48*a*, with the stopper section 48*b* inserted therethrough.

The spring unit 50 is constituted by the shape memory spring 51 and the bias spring 52. The shape memory spring 51 is formed in a coil spring shape using a Ni—Ti type shape memory alloy of which the elastic coefficient changes with temperature, for example, and maintains a uniform spring constant up to a prescribed temperature (transformation temperature), and upon reaching a prescribed temperature (transformation temperature) or above, the spring constant changes (increases) and the spring deforms in the direction of extension. On the other hand, the bias spring 52 is a coil spring having a substantially uniform spring constant which is independent of the temperature, and is disposed inside the shape memory spring 51.

This shape memory spring 51 senses the oil temperature of the lubricating oil, either directly or indirectly, and changes the spring constant thereof. As stated previously, the accommodating space 44 is connected with the oil pan T via a second drain oil passage 46 and the ambient air temperature inside the accommodating space 44 also changes in accordance with the temperature of the lubricating oil which is stored in the oil pan T (the ambient air temperature inside the oil pan T). Furthermore, the ball valve element 52 described hereinafter is exposed at all times to lubricating oil which flows in via the piston chamber 31, and the heat of the lubricating oil is transmitted to the shape memory spring 51. Consequently, the shape memory spring 51 changes spring constant by sensing the temperature of the lubricating oil indirectly, due to the ambient air temperature inside the accommodating space 44 and the transmission of heat from the ball valve element 53. On the other hand, if the connection hole 45 becomes open due to the movement of the ball valve element 53, then the lubricating oil inside the piston chamber 31 flows into the accommodating space 44 via the connection hole 45, and the lubricating oil contacts the shape memory spring 51 as it flows through the accommodating space 44. Therefore, the shape memory spring 51 receives the transmission of heat from the lubricating oil, due to the opening of the connection hole 45, and can be made to change spring constant by sensing the temperature of the lubricating oil directly.

The ball valve element 53 is formed in a spherical shape using a metal material having high thermal conductivity, for example. This ball valve element 53 is supported by a spring unit 50 inside the accommodating space 44, and is biased in one direction along the axial direction (a direction to close the connection hole 45) by the spring unit 50. Here, the bias spring 52 is interposed between the ball valve element 52 and the cap member 48 in a prescribed compressed state, and therefore biases the ball valve element 53 elastically toward a closed position (toward the connection hole 45 side) by a uniform biasing force, at all times. On the other hand, the shape memory spring 51 is interposed between the ball valve element 53 and the cap member 48, so as to assume a natural length (amount of spring extension=0) when the temperature is lower than the prescribed temperature, and therefore the shape memory spring 51 does not apply a biasing force to the ball valve element 53 when the temperature is lower than the prescribed temperature. If the temperature exceeds the prescribed temperature, however, then the shape memory spring 51 extends, the spring constant thereof increases, and the spring applies a biasing force on the ball valve element 53 in one direction along the axial direction (a direction to close the connection hole 45), in conjunction with the bias spring 52. In this way, the spring unit 50 applies the combined biasing force of the springs 51 and 52 to the ball valve element 53, this combined force changing appropriately in accordance with the temperature detected by the shape memory spring 51 (by sensing the temperature of the lubricating oil directly or indirectly). Therefore, the connection hole 45 of the switching valve 40 is normally closed off by the outer circumferential surface of the ball valve element 53, due to the action of the spring unit 50.

The opening and closing valve 30 is constituted by a piston chamber 31 which is formed as a round tubular internal space inside the casing 11, a piston 35 which is provided slidably in a direction approaching the relief valve 21 and a direction separating from the relief valve 21 (the leftward and rightward directions in FIG. 1 and FIG. 2) inside the piston chamber 31, and a valve spring 39 which is interposed between the piston 35 and the housing 41.

The piston chamber 31 is connected to the relief hole 21 inside the casing 11, and a first drain oil passage 34 connecting to the oil pan T is formed in the side surface section of the piston chamber 31. This first drain oil passage 34 is set to a closed state by the outer circumferential surface of the piston 35 when in a closed position.

The piston 35 is formed as a single body from a circular disk-shaped front plate section 36 and a tubular outer plate section 37, and has a bottomed round tubular shape which is open to one side of the axial direction (the rightward direction in FIG. 1). The interior of the piston chamber 31 is divided into an upstream chamber 32 and a downstream chamber 33 by the piston 35. An orifice 38 is formed to pass through the front plate section 36 of the piston 35 in the axial direction, and the relief hole 21 and the downstream chamber 33 are connected at all times via this orifice 38.

One end section of the valve spring 39 is supported by the front end section 36 of the piston 35, and the other end section of the valve spring 39 is supported by the small diameter section 42 of the housing 41, whereby the valve spring 39 biases the piston 35 to a closed position, namely, toward the relief hole 21, inside the piston chamber 31, at all times.

Next, the operation of the engine lubricating oil supply device 1 which is composed in this way will be described. The engine lubricating oil supply device 1 assumes an initial state shown in FIG. 1, when the engine is stopped. In this initial state, since the biasing force of the valve spring 39 acts on the piston 35, then the piston 35 is held in a closed position inside the piston chamber 31, and the first drain oil passage 34 is set to a closed state by the outer circumferential surface of the piston 35. Furthermore, in this initial state, since the biasing force of the spring unit 50 (the bias spring 52 only) acts on the ball valve element 53, then the ball valve element 53 is held in a closed position inside the accommodating space 44, and the connection hole 45 is closed off by the outer circumferential surface of the ball valve element 53.

When the engine is started up, the output shaft of the engine is driven to rotate, the gears 13, 14 are driven to rotate, and oil stored in the oil pan T is sucked into the intake hole 15, conveyed to the ejection hole 16 and then sent under pressure to the lubricating oil passage of the engine. The lubricating oil passage is formed in the engine case, and is composed in such a manner that the pressure of the supplied oil is raised in accordance with increase in the amount of oil supplied from the engine lubricating oil supply device 1.

The lubricating oil ejected from the oil pump 10 is sent to the lubricating oil path of the engine via the ejection hole 16, and is also sent to the oil regulating valve 20 via the relief hole 21 which is provided in the path of the ejection hole 16. In this case, since the biasing force of the spring unit 50 is greater than the oil pressure inside the piston chamber 31, then the connection hole 45 of the switching valve 40 is closed off by the ball valve element 53, and in this state, the lubricating oil passing through the relief hole 21 travels through the orifice 38 in the piston 35 and flows into the downstream chamber 33, whereby the oil pressure inside the downstream chamber 33 and the oil pressure inside the relief hole 21 (namely, the oil pressure on the front surface side and the rear surface side of the piston 35) become the same. Consequently, due to the biasing force of the valve spring 39, the piston 35 continues to be situated in a closed position on the side of the relief hole 21, and the connection between the relief hole 21 and the first drain oil passage 34 is shut off. Therefore, all of the oil ejected from the oil pump 10 is supplied to the engine.

In this case, if the engine output rises and the engine speed increases, then the speed of revolution of the oil pump 10 also increases, and therefore the flow rate of the lubricating oil supplied to the engine rises and the ejected oil pressure also rises. Here, the flow volume of lubricating oil required for lubrication of the engine is not necessarily proportional to the engine speed. Therefore, if the engine speed is increased in this state (if the speed of revolution of the oil pump 10 is increased), then the pressure of the lubricating oil rises, loss in engine output is produced, and therefore a portion of the lubricating oil is drained to lower the oil pressure. For instance, when the speed of the engine reaches a rated speed (number of revolutions) and the oil pressure becomes a prescribed pressure or higher (becomes higher than necessary), then the ball valve element 53 moves rightwards against the biasing force of the spring unit 50, in accordance with this oil pressure, thereby opening the connection hole 45, and lubricating oil inside the downstream chamber 33 flows into the accommodating space 44 in the housing 41, via the connection hole 45. The lubricating oil which has flowed into the accommodating space 44 in this way is relieved into the oil pan T via the second drain oil passage 46 which is formed to pass through the housing 41.

When the lubricating oil passes through the orifice 38 in this state, a pressure differential is produced between the front surface side and the rear surface side of the piston 35. In other words, the internal pressure of the downstream chamber 33 (the pressure on the rear surface side) becomes lower than the pressure inside the relief hole 21 and the upstream chamber 32 (the pressure on the front surface side), and therefore, as shown in FIG. 2, the piston 35 is pushed rightwards against the biasing force of the valve spring 39.

Here, the amount of rightward movement of the piston 35, in other words, the open surface area of the first drain oil passage 34, becomes larger, the greater the pressure differential between the upstream chamber 32 side and the downstream chamber 33 side of the piston 35. Therefore, a portion of the lubricating oil ejected from the oil pump 10 is relieved via the first drain oil passage 34 which is opened as a result of this pressure differential.

If the lubricating oil is relieved in this way, then the pressure of the lubricating oil supplied to the lubricating oil passage in the engine is reduced. When the oil pressure has fallen to the prescribed pressure, the biasing force of the spring unit 50 becomes greater than the pressure of the lubricating oil acting on the ball valve element 53, and the ball valve element 53 moves leftwards and closes the connection hole 45 again, thereby returning the oil pressures on the front surface side and the rear surface side of the piston 35 to the same pressure. By this means, the piston 35 slides to a closed position which is in the left end portion of the piston chamber 31, due to the biasing force of the valve spring 39, and the connection between the relief hole 21 and the first drain oil passage 34 is shut off. Consequently, all of the lubricating oil ejected from the oil pump 10 passes along the lubricating oil passage and is supplied to the engine.

Figure 3:
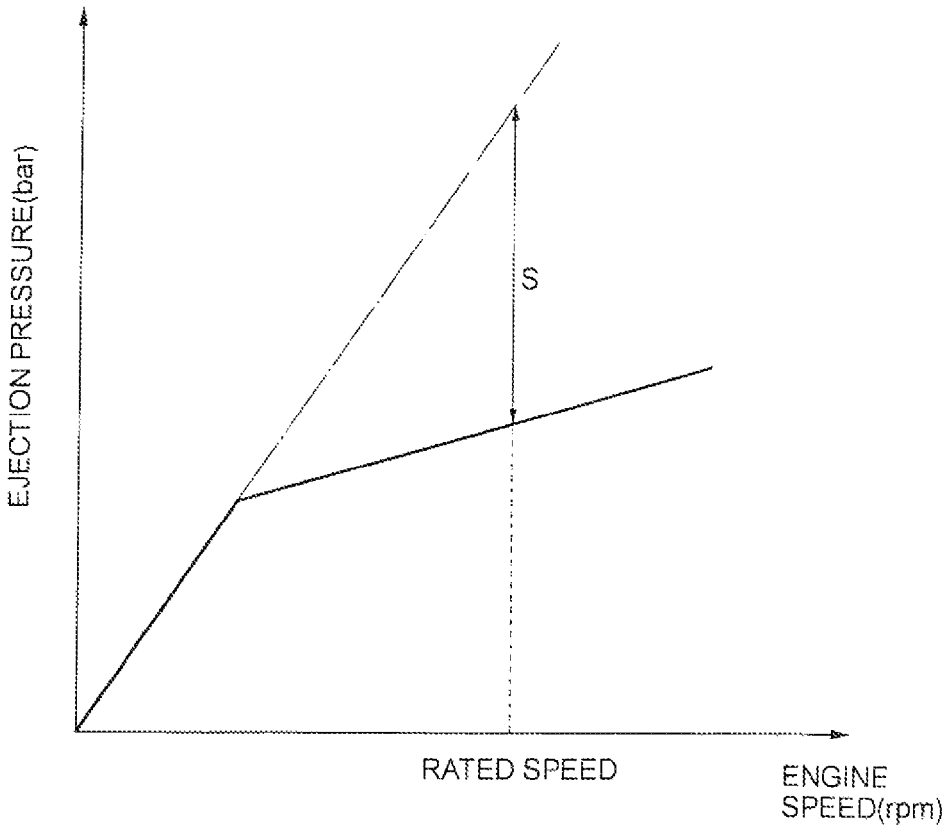
FIG. 3 is a graph showing a relationship between the engine speed and the ejection pressure in the engine lubricating oil supply device described above.

In this way, it is possible to change the amount of lubricating oil relieved, of the lubricating oil which is supplied from the oil pump 10 to the engine, in accordance with the pressure of the lubricating oil ejected from the oil pump 10 which rotates in proportion with the speed of the engine. By controlling the flow volume of the lubricating oil supplied to the engine in such a manner that the relationship between the speed of the engine and the ejection pressure is the relationship indicated by the solid line on the graph in FIG. 3, it is possible to achieve an oil pressure which corresponds to the oil flow volume actually required for lubrication of the engine. Consequently, for instance, when the engine is running at the rated speed, it is possible to reduce the ejection pressure by S in FIG. 3, compared to an oil pump which does not perform relief of the lubricating oil, and therefore it is possible to reduce the output loss of the engine.

In order to improve fuel consumption of the engine in this way, it is necessary to make efficient use of the engine output, as well as lubricating and cooling the respective parts of the engine with the lubricating oil from the oil pump 10. Here, the amount of work performed by the oil pump 10 varies with the temperature of the lubricating oil, and since the viscosity of the lubricating oil is high when the temperature of the oil is low during cold start-up of the engine, for instance, then the amount of work performed by the oil pump 10 increases even at the same oil pressure, compared to when the oil temperature is low. Therefore, operating the oil pump 10 more than necessary, irrespective of the temperature of the oil, means that the oil pump 10 performs an excess amount of work, as a result of which the friction becomes higher and the fuel consumption of the engine is reduced.

In order to correct problems of this kind, in an engine lubricating oil supply device 1 relating to the present embodiment, by adopting a mechanism whereby the pressing force which biases the ball valve element 53 (the combined biasing forces of the two springs 51, 52) varies with the temperature of the lubricating oil as sensed either directly or indirectly by the shape memory spring 51, by utilizing the change in the spring constant of the shape memory spring 51 in accordance with the sensed temperature, then it is possible to change the operating pressure of the oil regulating valve 20 for relieving the lubricating oil, in accordance with the oil temperature.

As described above, in the switching valve 40, since the spring constant of the shape memory spring 51 changes in accordance with the sensed temperature, then the operating pressure (hydraulic pressure of the lubricating oil) required to move the ball valve element 53 rightwards against the biasing force of the spring unit 50 so as to open the connection hole 45 also varies with the sensed temperature.

Figure 4:
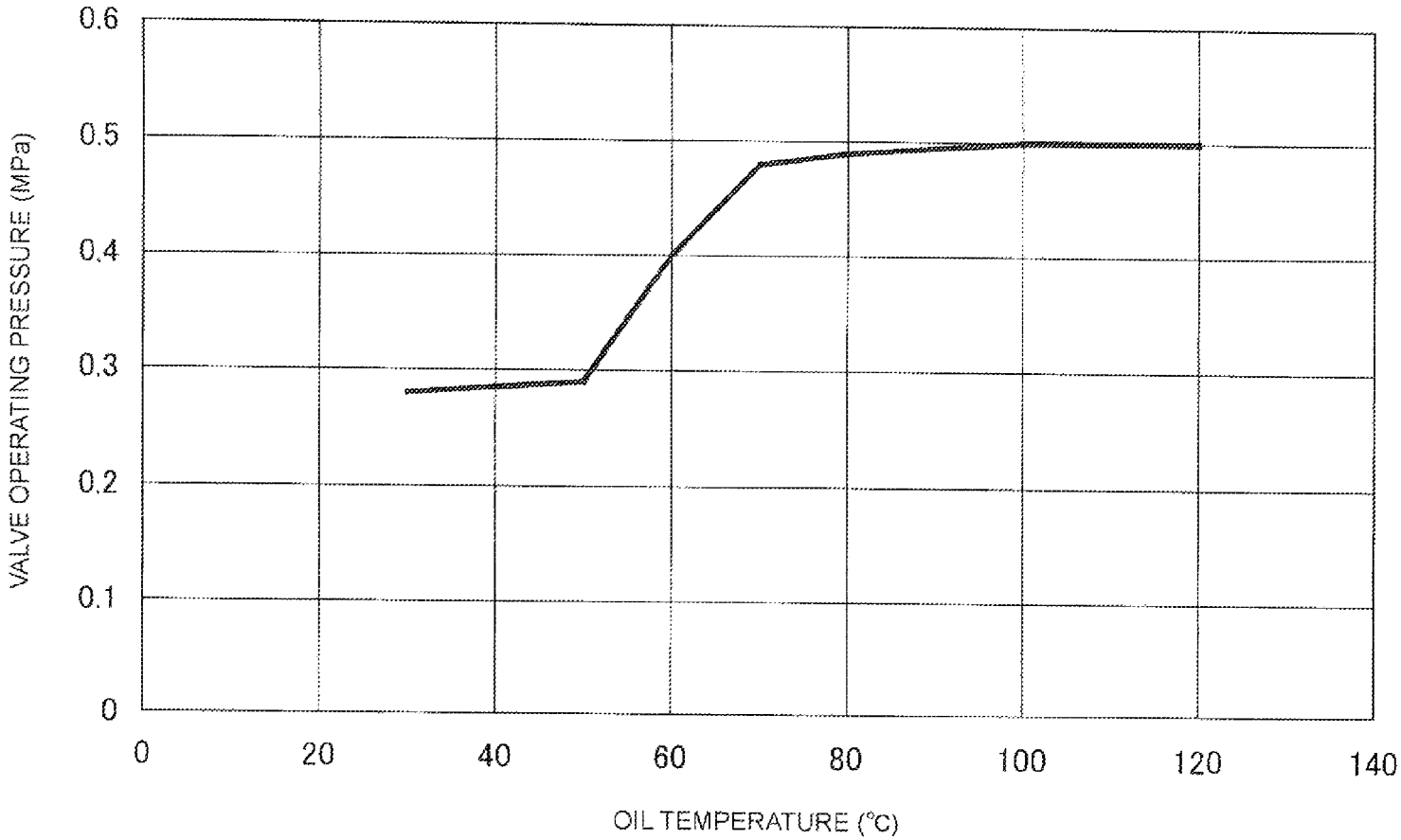
FIG. 4 is a graph showing a relationship between the oil temperature and the valve operating pressure in the engine lubricating oil supply device described above.

Here, FIG. 4 shows the relationship between the temperature of the lubricating oil and the operating pressure of the oil regulating valve 20. If the transformation temperature of the shape memory spring 51 is 50° C., then when the temperature of the lubricating oil is less than 50° C. (a low temperature state), only the biasing force of the bias spring 52 of the spring unit 50 acts on the ball valve element 53, and therefore the operating pressure for moving the piston 35 rightwards is relatively low. On the other hand, if the temperature of the lubricating oil is 50° C. or higher (a high temperature state), then the shape memory spring 51 extends due to the temperature rise, the spring constant also rises, and therefore a combined biasing force of the two springs 51, 52 acts on the ball valve element 53 in addition to the biasing force of the bias spring 52, and the operating pressure for moving the piston 35 rightwards becomes higher with the oil temperature. Moreover, if the temperature of the lubricating oil exceeds 70° C., then the shape memory spring 51 is kept in the original memory state, the spring constant is virtually uniform, and the operating pressure for moving the piston 35 rightwards is kept virtually uniform.

Since the operating pressure of the oil regulating valve 20 becomes higher in accordance with the increase in the temperature of the lubricating oil in this way, then the volume of relieved oil, of the oil ejected from the oil pump 10, is adjusted on the basis of the temperature of the lubricating oil, so as to increase the volume of lubricating oil relieved when the lubricating oil is at a low temperature, in other words, in a high-viscosity state.

Figure 5:
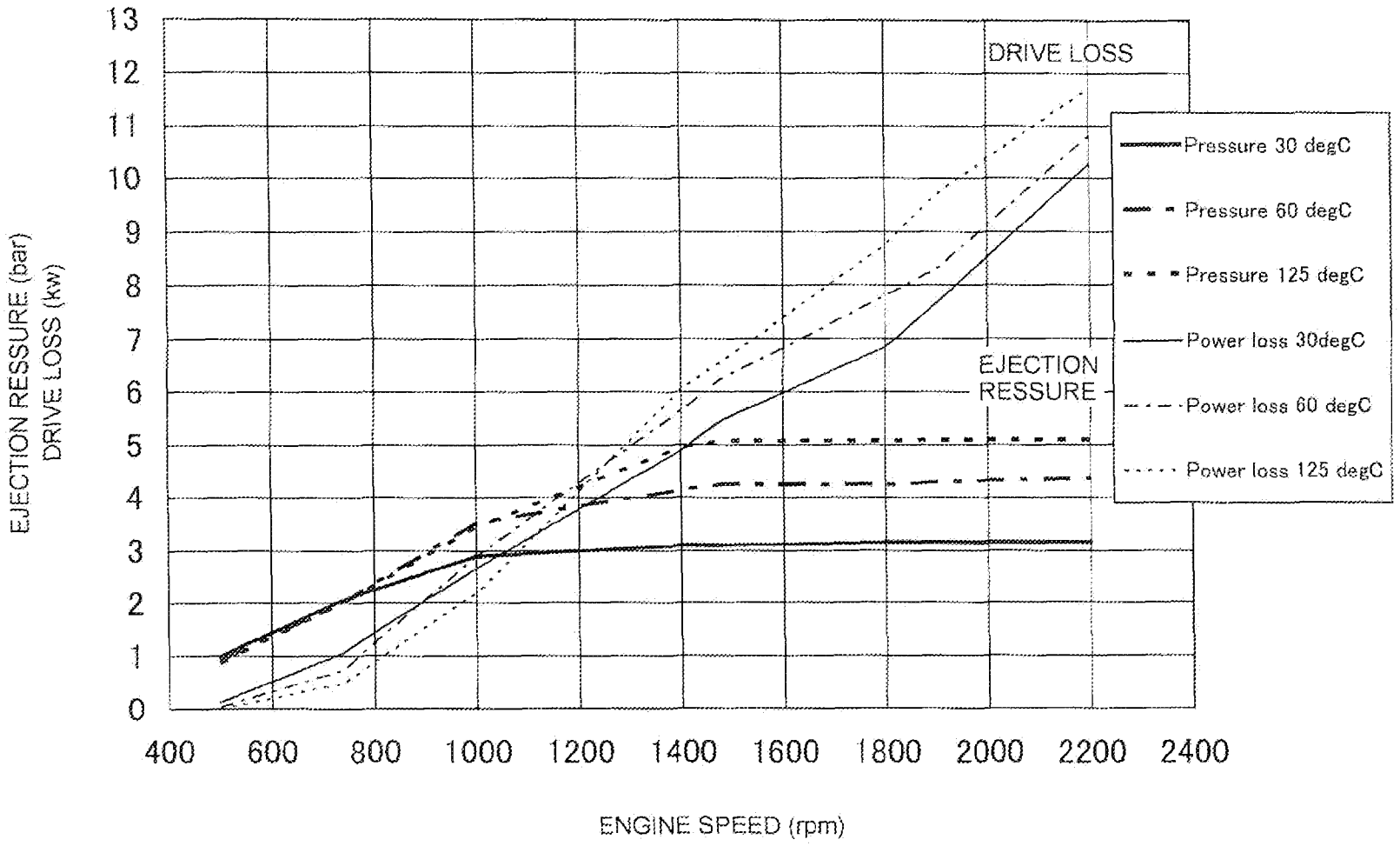
FIG. 5 is a graph showing a relationship between the engine speed, the ejection pressure and the drive loss, in the engine lubricating oil supply device described above.

Here, FIG. 5 shows the relationship between the engine speed, the ejection pressure and the drive loss, when the temperature of the lubricating oil is 30° C., 60° C. and 125° C., in the engine lubricating oil supply device 1. When the ejection pressure from the oil pump 10 at 30° C., 60° C. and 125° C. is compared, in accordance with the change in the valve operating pressure corresponding to the temperature of the lubricating oil described above, the ejection pressure is kept low at an oil temperature of 30° C. which is lower than the transformation temperature of the shape memory spring 51, the ejection pressure becomes high at a temperature of 60° C. which exceeds the transformation temperature, and the ejection pressure becomes even higher at a higher temperature of 125° C. In this way, at a low oil temperature where the viscosity is high, such as when the engine is started from cold, it is possible to lower the excessive amount of work performed by the oil pump 10 at low temperature (to reduce the output loss of the engine), by raising the relief volume of the lubricating oil so as to maintain a low ejection pressure. By progressively reducing the relief volume of the lubricating oil and raising the ejection pressure as the oil temperature rises, it is possible to supply an oil volume which matches the requirements of the engine, in a high-output high-speed region (a state where the engine load is high), when the oil temperature is high. Furthermore, it is also possible to achieve quick warm-up by promoting the warming of the engine, through reducing the flow volume of oil supplied to the engine, when the oil temperature is low, such as when starting up the engine.

According to the engine lubricating oil supply device 1 relating to the present embodiment described above, it is possible to adjust the operating pressure of the oil regulating valve 20 for opening the lubricating oil drain passages 34, 46, on the basis of the balance between the pressure of the lubricating oil supplied to the engine from the oil pump 10 which rotates in direct proportion to the speed of the engine, and the spring biasing force of the spring unit 50 which changes by sensing the temperature of the lubricating oil directly or indirectly. Therefore, it is possible to adjust the volume of oil relieved, of the lubricating oil supplied to the engine from the oil pump 10, appropriately, in accordance with the speed of revolution of the oil pump 10 and the temperature of the lubricating oil. Consequently, it is possible to supply oil of a required volume in accordance with the speed of the engine, appropriately, as well as being able to use the engine output efficiently and hence to improve the fuel consumption of the engine, without causing the oil pump 10 to perform an excessive amount of work (without raising the friction), by reducing the pump ejection pressure under low temperature conditions where the lubricating oil has a high viscosity, such as during cold start-up, for instance.

Furthermore, according to the engine lubricating oil supply device 1 of the present embodiment, since the control of the flow volume of the lubricating oil corresponding to the oil temperature is achieved by means of a simple composition which does not employ any electrical control by a controller (ECU), then it is also possible to achieve reduced costs, reduced space, and energy savings, and the like.

A desirable embodiment of the present invention has been described thus far, but the present invention is not limited to this embodiment. For example, in the embodiment described above, an external meshing type of gear pump is described as an example of an oil pump, but the oil pump is not limited to this and similar beneficial effects can be obtained if another oil pump, such as an internal meshing gear pump, a trochoid pump, or the like, is used. Furthermore, in an external meshing type of gear pump, it is also possible to adopt a composition in which a two-set gear pump is formed by arranging three gears (toothed wheels) in a row inside one casing, providing an oil regulating valve only in the ejection channel of one of the gear pumps, and adjusting the ejection volume of this gear pump on the basis of the engine speed, the oil temperature and the oil pressure.

Moreover, in the embodiment described above, an example is given in which the valve element 53 for opening and closing the connection hole 45 is formed in a spherical shape, but the shape of the valve element is not limited to this and may also be a hemispherical shape, a round conical shape, or the like.

Furthermore, it is also possible to adjust the valve operating pressure more accurately in accordance with the temperature of the lubricating oil, by means of the shape memory spring 51 sensing the oil temperature directly, by providing supply means for appropriately supplying a small quantity of lubricating oil to the shape memory spring 51 from the oil pan T, or by providing a flow channel for the lubricating oil which supplies, to the shape memory spring 51, a small quantity of pressurized oil (lubricating oil), of the lubricating oil in the piston chamber 31 or the ejection hole 16, in an amount which does not substantially produce variation in the ejection pressure.

Furthermore, in the embodiment described above, an example is given in which the transformation temperature of the shape memory spring 51 is 50° C., but the transformation temperature is not limited to this and may also be varied appropriately in accordance with the required performance of the engine, and the like.

EXPLANATION OF NUMERALS AND CHARACTERS

1 engine lubricating oil supply device
10 oil pump
11 casing
20 oil regulating valve
21 relief hole
30 opening and closing valve
31 piston chamber
32 upstream chamber (front surface side space)
33 downstream chamber (rear surface side space)
34 first drain oil passage
35 piston (piston member)
38 orifice
39 valve spring (first biasing means)
40 switching valve
41 housing
44 accommodating space
45 connection hole (valve hole)
46 second drain oil passage
50 spring unit (second biasing means)
51 shape memory spring
52 bias spring
53 ball valve element (valve element)
O lubricating oil
T oil pan

The invention claimed is:

1. An engine lubricating oil supply device comprising an oil pump which is driven by an engine, sucks in lubricating oil stored in an oil pan, and supplies the lubricating oil to lubricated parts of the engine; and an oil supply regulating valve which conveys a portion of the lubricating oil supplied to the lubricated parts of the engine from the oil pump, to a first drain oil passage via a relief hole connecting to an outlet port of the oil pump, and drains a rest portion of the lubricating oil to the oil pan, wherein the oil supply regulating valve includes:

a casing having a piston chamber connected to the relief hole;

a piston member which is slidably inserted into the piston chamber to divide the piston chamber into an upstream chamber which is connected with the relief hole and a downstream chamber and moves in the piston chamber to open and close the communication between the first drain oil passage and the upstream chamber;

first biasing means which biases the piston member toward a closed position so as to close the first drain oil passage to the relief hole;

an orifice which is formed in the piston member and connects the upstream chamber with the downstream chamber;

a housing which is provided in the casing facing the downstream chamber, where an accommodation space, a connection hole for connecting the accommodation space with the downstream chamber, and a second drain oil passage for connecting the accommodation space with the oil pan are formed in the housing;

a valve element which is provided inside the accommodating space and opens and closes the valve hole; and second biasing means which biases the valve element toward a closed position so as to close the connection hole, where the second biasing means is provided in the accommodation space and produces a biasing force corresponding to a temperature of the lubricating oil in the accommodation space, wherein the second biasing means includes a shape memory spring which, directly or indirectly, senses the temperature of the lubricating oil and applies a biasing force corresponding to the sensed temperature to the valve element toward closing direction, and a bias spring which applies a biasing force to the valve element in the valve closing direction, wherein a combined biasing force by the shape memory spring and the bias spring is applied to the valve element such that: (1) when the lubricating oil temperature is less than a first temperature, only the biasing force of the bias spring acts on the valve element, (2) when the lubricating oil temperature is greater than the first temperature and less than a second temperature, the combined biasing force of the bias spring and the shape memory spring acts on the valve element as the shape memory spring extends in response to a temperature increase of the lubricating oil, and (3) when the lubricating oil temperature is greater than the second temperature, the shape memory spring is kept in its original memory state, a spring constant of the shape memory spring is virtually uniform, and an operating pressure for moving the piston is kept virtually uniform, wherein the first temperature is a low temperature where the viscosity is high, such as when the engine is started from cold, and the second temperature is seventy degrees Celsius (70° C.).

2. The engine lubricating oil supply device according to claim 1, wherein the valve element opens and closes the connection hole based on a balancing of a closing biasing force and an opening biasing force, the closing biasing force being produced by the second biasing means corresponding to a temperature of the lubricating oil in the accommodation space and the opening biasing force being produced by an oil pressure acting on the valve element, the oil pressure being supplied from the downstream chamber through the connection hole;

when the connection hole is opened by the valve element, lubricating oil in the downstream chamber is flowed into the accommodation space and also flowed out through the second drain passage, lubricating oil flows from the upstream chamber to the downstream chamber through the orifice, creating a pressure difference between the upstream chamber and the downstream chamber, and the piston member is moved by a balance of the pressure difference and the biasing force of the first biasing means for controlling the opening degree of the first drain passage to the relief hole.

3. The engine lubricating oil supply device according to claim 2, wherein the first temperature is fifty degrees Celsius (50° C.).

4. The engine lubricating oil supply device according to claim 1, wherein the first temperature is fifty degrees Celsius (50° C.).

* * * * *